US010697245B2

(12) United States Patent
Jaffrey

(10) Patent No.: US 10,697,245 B2
(45) Date of Patent: Jun. 30, 2020

(54) SEABED DRILLING SYSTEM

(71) Applicant: CAMERON INTERNATIONAL CORPORATION, Houston, TX (US)

(72) Inventor: Andrew Jaffrey, Oldmeldrum (GB)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 15/561,414

(22) PCT Filed: Mar. 23, 2016

(86) PCT No.: PCT/US2016/023827

§ 371 (c)(1),
(2) Date: Sep. 25, 2017

(87) PCT Pub. No.: WO2016/154348

PCT Pub. Date: Sep. 29, 2016

(65) Prior Publication Data

US 2018/0106111 A1 Apr. 19, 2018

Related U.S. Application Data

(60) Provisional application No. 62/137,667, filed on Mar. 24, 2015.

(51) Int. Cl.
*E21B 7/124* (2006.01)
*E21B 4/18* (2006.01)
(Continued)

(52) U.S. Cl.
CPC ..... *E21B 7/124* (2013.01); *E21B 4/18* (2013.01); *E21B 7/20* (2013.01); *E21B 7/208* (2013.01); *E21B 33/138* (2013.01); *E21B 17/01* (2013.01)

(58) Field of Classification Search
CPC ..... E21B 7/124; E21B 7/20; E21B 33/138; E21B 4/18; E21B 17/01; E21B 19/143; E21B 7/068; E21B 7/12
See application file for complete search history.

(56) References Cited

U.S. PATENT DOCUMENTS 2,614,804 A * 10/1952 Carlisle ..... E21B 7/124 102/314
3,512,592 A * 5/1970 Kellner ..... E21B 7/124 175/230

(Continued)

FOREIGN PATENT DOCUMENTS

CN 102322219 A 1/2012
EP 1703073 A1 9/2006

(Continued)

OTHER PUBLICATIONS

International Search Report and Written Opinion for the equivalent International patent application PCT/US2016/023827 dated Jun. 15, 2016.

(Continued)

*Primary Examiner* — James G Sayre
(74) *Attorney, Agent, or Firm* — Helene Raybaud

(57) ABSTRACT

The present disclosure relates generally to a well boring apparatus, and associated components, for drilling wellbores without the necessity of traditional well drilling equipment. The well boring apparatus operates on similar principles as a tunnel boring apparatus. The well boring apparatus is self-propelled, steerable, and can be launched from a topside vessel or directly from a seabed installation. The well boring apparatus is fully instrumented and capable of analyzing the surrounding environment including the temperature, pressure, acidity and the presence of particular chemicals. The well boring apparatus is highly modular such that it can be configured for different tasks. The well boring apparatus can (Continued)

include components to case/line the wellbore during drilling, eliminating the need for running casing/lining. Further, the well boring apparatus can be incorporated in a drilling system in which cuttings are processed at the seabed, thereby removing the need for a drilling riser.

17 Claims, 5 Drawing Sheets

(51) Int. Cl.

| | |
|---|---|
| ***E21B 7/20*** | (2006.01) |
| ***E21B 33/138*** | (2006.01) |
| ***E21B 17/01*** | (2006.01) |

(56) References Cited

U.S. PATENT DOCUMENTS

| | | | | |
|---|---|---|---|---|
| 3,741,320 | A | 6/1973 | Hilfing | |
| 4,102,415 | A * | 7/1978 | Cunningham | E21B 4/04 175/104 |
| 5,010,965 | A | 4/1991 | Schmelzer | |
| 5,047,990 | A | 9/1991 | Gafos et al. | |
| 5,074,366 | A * | 12/1991 | Karlsson | E21B 7/068 166/381 |
| 5,186,264 | A * | 2/1993 | du Chaffaut | E21B 4/18 175/230 |
| 5,316,094 | A | 5/1994 | Pringle | |
| 5,394,951 | A | 3/1995 | Pringle et al. | |
| 6,601,652 | B1 | 8/2003 | Moore et al. | |
| 7,090,037 | B2 * | 8/2006 | Best | E21B 4/18 166/212 |
| 7,493,948 | B2 | 2/2009 | Cooper et al. | |
| 7,686,100 | B2 | 3/2010 | Codazzi et al. | |
| 7,743,849 | B2 | 6/2010 | Kotsonis et al. | |
| 7,849,935 | B2 | 12/2010 | Johnson et al. | |
| 7,931,091 | B2 | 4/2011 | Bailey et al. | |
| 7,946,360 | B2 | 5/2011 | Orban et al. | |
| 8,011,453 | B2 | 9/2011 | Lavrut et al. | |
| 8,191,652 | B2 | 6/2012 | Kotsonis et al. | |
| 8,307,917 | B2 | 11/2012 | Kotsonis et al. | |
| 8,511,401 | B2 | 8/2013 | Zediker et al. | |
| 8,636,085 | B2 | 1/2014 | Rinzler et al. | |
| 8,820,434 | B2 | 9/2014 | Zediker et al. | |
| 2002/0040783 | A1 | 4/2002 | Zimmerman et al. | |
| 2005/0072577 | A1 * | 4/2005 | Freeman | E21B 34/14 166/386 |
| 2005/0115741 | A1 * | 6/2005 | Terry | G01V 3/30 175/61 |
| 2007/0107941 | A1 * | 5/2007 | Fillipov | E21B 4/18 175/57 |
| 2008/0087423 | A1 | 4/2008 | Wylie et al. | |
| 2009/0038854 | A1 * | 2/2009 | Johnson | E21B 4/04 175/62 |
| 2009/0178848 | A1 * | 7/2009 | Nellessen, Jr. | E21B 7/12 175/7 |
| 2011/0203848 | A1 * | 8/2011 | Krueger | E21B 21/08 175/57 |
| 2016/0319633 | A1 | 11/2016 | Cooper et al. | |
| 2018/0355674 | A1 | 12/2018 | Cooper et al. | |

FOREIGN PATENT DOCUMENTS

| | | | | |
|---|---|---|---|---|
| EP | 1780372 | A1 | 5/2007 | |
| EP | 1867831 | A1 | 12/2007 | |
| GB | 2405654 | A * | 3/2005 | E21B 21/00 |
| RU | 2507382 | C1 | 2/2014 | |
| WO | 1999/015758 | A2 | 4/1999 | |
| WO | 2004/018826 | A1 | 3/2004 | |
| WO | 2005/024173 | A1 | 3/2005 | |
| WO | 2007/129899 | A1 | 11/2007 | |
| WO | 2008/130242 | A1 | 10/2008 | |
| WO | 2016/065233 | A1 | 4/2016 | |
| WO | 2016/065235 | A1 | 4/2016 | |
| WO | 2016/065244 | A1 | 4/2016 | |
| WO | 2016/069596 | A1 | 5/2016 | |
| WO | 2016/069597 | A1 | 5/2016 | |
| WO | 2016/154348 | A1 | 9/2016 | |

OTHER PUBLICATIONS

International Preliminary Report on Patentability for the equivalent International patent application PCT/US2016/023827 dated Oct. 5, 2017.

International Search Report and Written Opinion for the cross referenced International patent application PCT/US2016/051111 dated Jan. 24, 2017.

International Preliminary Report on Patentability for the cross referenced International patent application PCT/US2016/051111 dated Mar. 13, 2018.

The Robbins Company, Rockhead, Small Boring Machines, 2016. http://www.therobbinscompany.com/products/small-boring-machines/rockhead/.

* cited by examiner

SEABED DRILLING SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Drilling offshore oil and gas wells traditionally includes the use of surface equipment for the exploitation of subsea petroleum and natural gas deposits. In deep water applications, surface equipment can include floating platforms (e.g., spars, tension leg platforms, extended draft platforms, and semi-submersible platforms) or vessels (e.g., drill ships).

The surface equipment typically supports risers that extend from one or more wellheads or structures on the seabed to the equipment at the sea surface. The risers connect the subsea well with the surface equipment to protect the fluid integrity of the well and to provide a fluid conduit to and from the wellbore. The risers connecting the surface wellhead to the subsea wellhead can be thousands of feet long and extremely heavy.

Drilling operations including surface equipment are generally associated with substantial operating costs. In addition, the offshore environment can be hazardous for personnel working on the surface equipment or below the surface. Weather often impacts operations and requires that work stop until conditions improve, resulting in time delays and additional costs. The time required to recover defective equipment from the well to the rig and to be returned to the well can amount to days for the transit periods alone. In view of these issues, an alternative approach to deepwater subsea drilling would be beneficial.

BRIEF DESCRIPTION OF THE DRAWINGS

Illustrative embodiments of the present disclosure are described in detail below with reference to the attached drawing figures, which are incorporated by reference herein and wherein.

Figure 1:
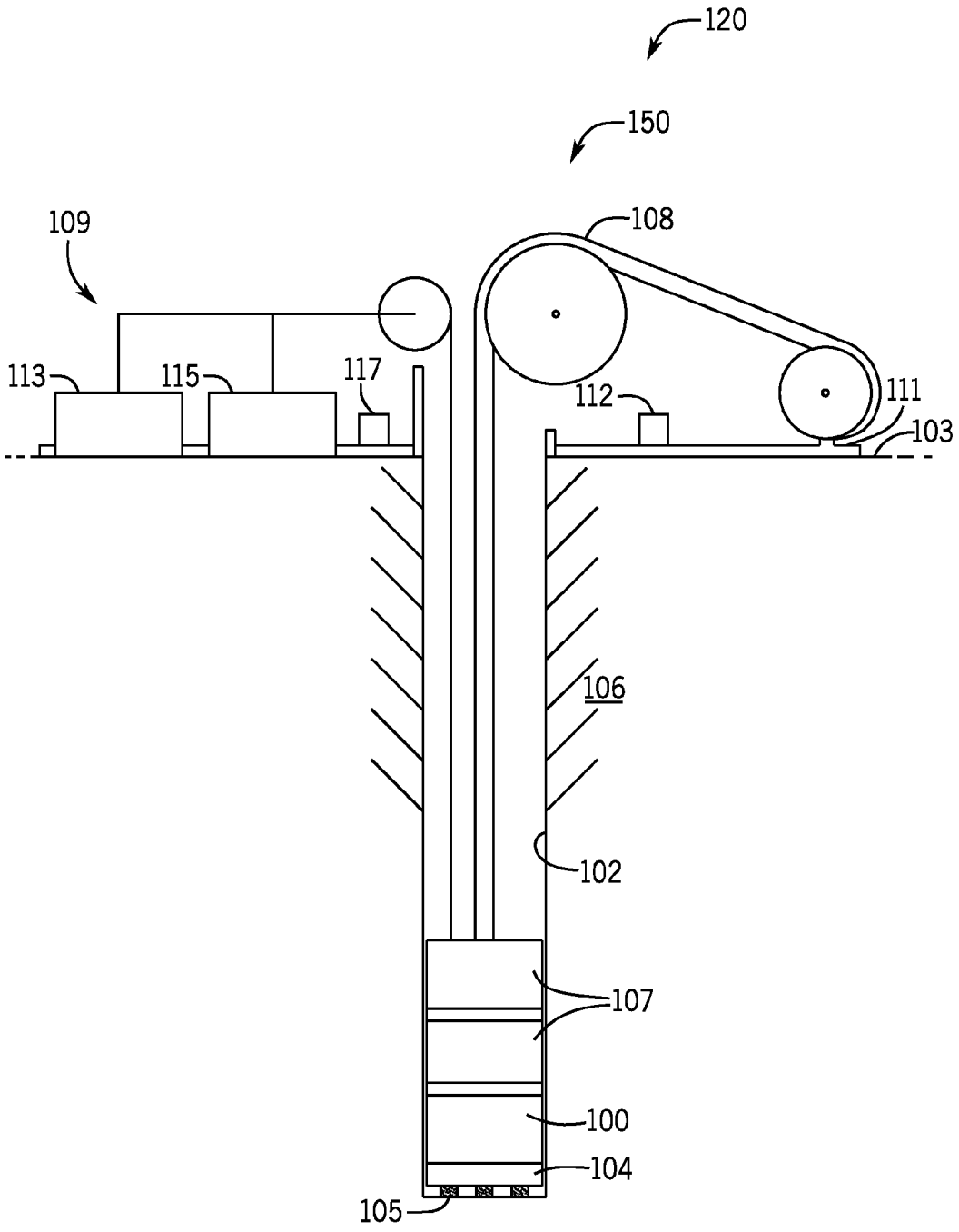
FIG. 1 is a schematic view of an example drilling system.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

The present disclosure relates generally to a well boring apparatus for drilling wellbores without the necessity of traditional well drilling equipment. The well boring apparatus may be self-propelled, steerable, and can be launched from a topside vessel or directly from a seabed installation. The well boring apparatus is fully instrumented including myriad sensors (e.g., temperature, pressure, torque, force, depth, angle, speed (rotational and travel), inclination, accelerometer, location, flow rate), and navigation tools such as an inertial navigation system. The well boring apparatus is capable of analyzing the surrounding environment, including the temperature, pressure, acidity and the presence of particular chemicals. The well boring apparatus is highly modular such that it can be configured for different tasks or fitted with different modules to support specific downhole activities. The well boring apparatus can include components to case/line the wellbore during drilling, eliminating the need for running casing/lining. Further, the well boring apparatus can be incorporated in a drilling system in which cuttings are processed at the seabed, thereby removing the need for a drilling riser.

Referring now to FIG. 1, a schematic view of a drilling system 120 for drilling through a subterranean formation according to the present disclosure is shown. The system 120 includes a well boring apparatus 100 for drilling a wellbore 102. The well boring apparatus 100 is shown launched from the sea floor or "mud line" 103. However, the well boring apparatus 100 can be launched from a surface location as well, such as a drilling rig or ship. The well boring apparatus 100 includes a feature for elongating a wellbore, such as rotating cutting wheel 104. The rotating cutting wheel 104 has one or more teeth 105 disposed on it. The teeth 105 are contacted with a portion of a formation 106 to be drilled through.

The well boring apparatus 100 is at least in part self-propelled. That is, the well boring apparatus 100 includes a thrust system for propelling the apparatus 100 through the wellbore 102. The well boring apparatus 100 can be coupled to a coiled tubing spool 108. The coiled tubing spool 108 can provide additional thrust for moving the well boring apparatus 100 through the wellbore 102. The coiled tubing spool 108 can also be used to retrieve the well boring apparatus 100 from the hole. The coiled tubing spool 108 can be located at a seabed installation 150 or at a surface location. The well boring apparatus 100 is detachable from the coiled tubing spool 108 and can be swapped-out remotely for other downhole tools as necessary.

In addition, the well boring apparatus 100 can be used with or without the coiled tubing spool 108, i.e., relying solely on the thrust system disposed on the well boring apparatus 100. In either instance, the well boring apparatus 100 can include a recovery line attached to a winch located at the mud line 103 or at the surface for rapid retrieval of the well boring apparatus 100. The seabed installation 150 includes a launch and recovery guide frame for properly aligning the well boring apparatus 100 during insertion or withdrawal. The well boring apparatus 100 may be inserted directly into the wellbore 102. Alternatively, the well boring apparatus 100 can be inserted into the wellbore via an insertion system akin to a pig launcher. Specifically, the well boring machine 100 can be contained in a separate pipeline selectively in fluid communication with the wellbore 102. In this arrangement, the entire drilling system is sealed off from the external environment. When introducing the well boring machine 100 to the wellbore 102, the well boring apparatus 100 is put into fluid communication with the wellbore 102 and can proceed into the wellbore 102. Even during insertion of the well boring apparatus 100 into the wellbore 102, the entire system remains sealed from the external seawater environment.

The well boring apparatus 100 is fully steerable. Accordingly, the direction of the well bore 102 can be changed at any time during the drilling process. Steering control signals may be provided from a surface location or from the seabed location 150. The direction of drilling can be manipulated by changing characteristics of the portion of the cutting wheel 104 contacting the formation (e.g., changing the location, number, or type of teeth 105, the angle of the cutting wheel 104 relative the formation 106, the portions of the cutting wheel 104 in contact with the formation 106, etc.). By changing the characteristics of the face of the cutting wheel 104, the direction of drilling can be controlled. It is envisioned that the characteristics of the cutting wheel 104 can be changed after retrieval of the well boring apparatus 100 from the wellbore 102 or in real time during drilling operations. Further, the thrust direction exerted by the self-propelling elements of the well boring apparatus 100 may be used to control the direction of travel.

The well boring apparatus 100 may further include one or more secondary modules 107 (e.g., removable portions or portions having physically separate support structures or frames). The secondary modules 107 will be discussed in greater detail below. In general, the secondary modules 107 can include additional equipment for lining/casing the wellbore, propelling drilling fluid to the mud line 103, processing drill cuttings, etc. The secondary modules 107 can be coupled to the well boring apparatus 100 directly or indirectly.

The well boring apparatus 100 can be in signal communication (fluid, optical, electrical, wireless, acoustic, radio, inductive, and/or magnetic) with one or more modular systems 109 disposed on a skid at the seabed installation 150. The skid configuration can be circular so that the modular systems 109 are distributed around the wellbore 102. The skid can be of other geometries suitable for drilling operations. Since the skid surrounds the wellbore 102, tall items such as a launch and recovery guide are more stable than a skid where a derrick-type structure stands at one end.

The modular systems 109 can include modularly packaged equipment (e.g., having physically separate frames or support structures) for providing power to the well boring apparatus 100, monitoring the conditions of the formation 106, controlling tools on the well boring apparatus 100, communicating with a computer system at a remote location, chemical storage for chemicals to be injected into the formation, storage for lining, casing, cementing equipment and constituent supplies, cuttings processing equipment, and other subsea and/or downhole operations. For example, the modular systems 109 may includes a control/monitoring system 113 (e.g., an electronic controller having a processor and a memory) and/or a power/control/communication system 115 (e.g., an electronic controller having a processor and a memory). The modular systems 109 may include storage 117, such as for chemical storage, storage for lining, casing, cementing equipment and constituent supplies, cuttings processing equipment, and other subsea and/or downhole operations. The modular systems 109 can be installed and retrieved directly or with the use of a remotely operated vehicle or an autonomous underwater vehicle. The modular systems 109 have similar footprints so that one system can be swapped with another seamlessly.

Power sources for powering the well boring apparatus 100 and associated equipment (e.g., modular systems 109, secondary modules 107, etc.) can include, but are not limited to fuel cells, energetic materials, aqua batteries, direct electrical supply from rig, indirect electrical supply from rig, indirect supply via remotely operated vehicle, and/or hydraulic fluid.

The seabed installation 150 can be on one or more skids deployed from a surface vessel such as a drilling rig or ship. All equipment associated with the seabed installation 150 can be deployed from a construction vessel rather than a conventional drilling unit. The equipment is secured to the skids using ball and taper units to allow for quick-release disconnection by remotely operated vehicle and hoisting back to surface for major intervention as required.

The seabed installation 150 can further include robotic or remotely controlled actuators to manipulate equipment (e.g., tasks such as swapping-out boring head for downhole instrumentation, lifting pre-formed casing into the hole, etc.). The installation 150 can also include video cameras 112 to allow remote viewing of subsea operations at the seabed installation 150.

Figure 2:
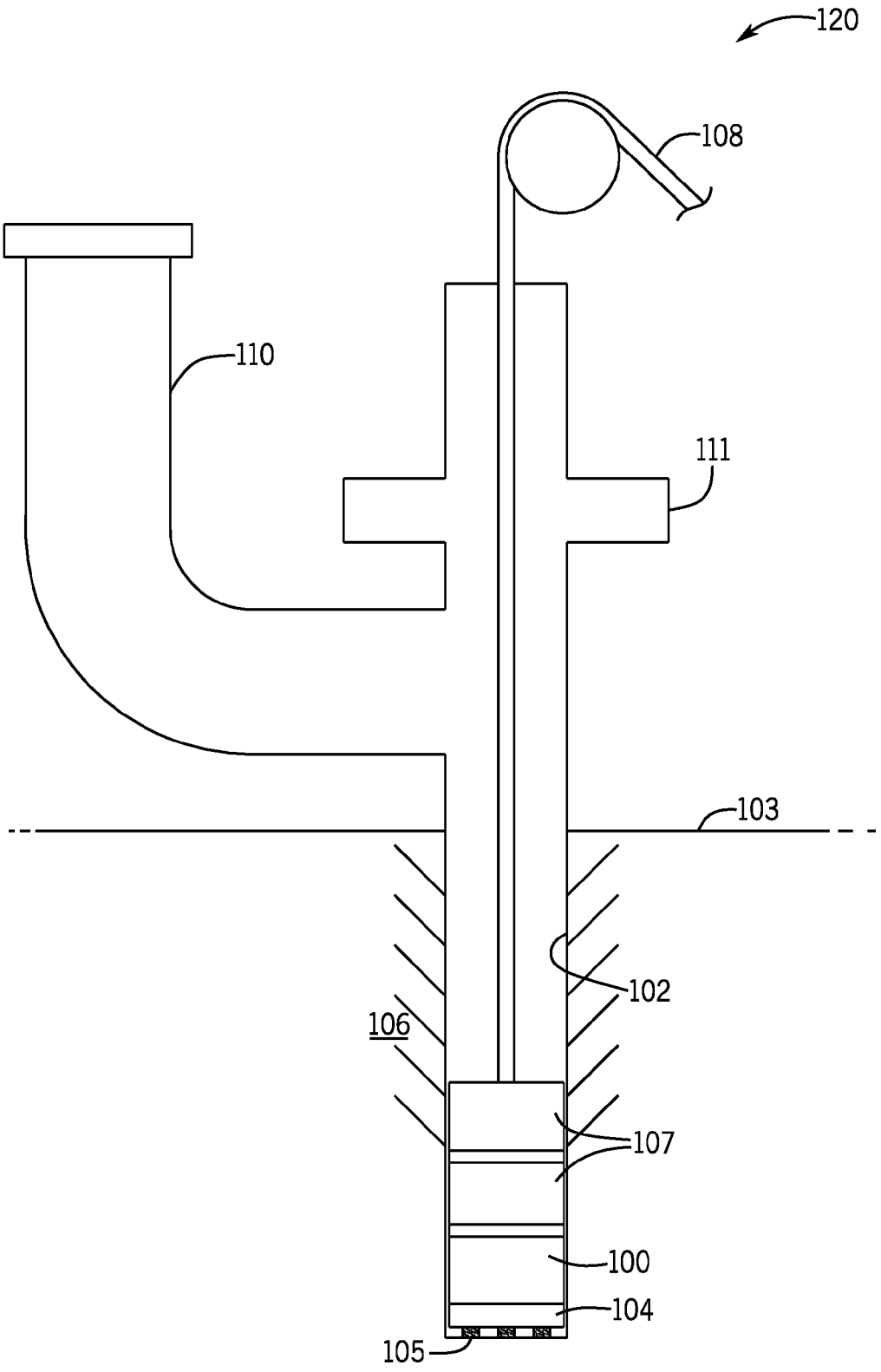
FIG. 2 is a schematic view of an example drilling system including pressure control equipment and a riser.

Referring now to FIG. 2, a schematic view of a drilling system 120 for drilling through a formation 106 according to the present disclosure is shown. The system 120 includes a well boring apparatus 100 as illustrated in FIG. 1. The system further includes an annular blowout preventer stack 111 in line with the wellbore 102. The coiled tubing 108 passes through the blowout preventer stack 111 and is coupled to the well boring apparatus 100. The blowout preventer stack 111 functions to control the pressure in the wellbore 102. The closing pressure on the annular blowout preventer stack 111 can be eased simultaneously with the advancement of the well boring apparatus 100 and the pushing/feeding of any coiled tubing 108 attached to the well boring apparatus 100. This allows for the coiled tubing 108, or other connection to the well boring apparatus 100, to more easily pass through the annular blowout preventer stack 111, after which the annular blowout preventer stack 111 closing pressure can be increased again.

The system 120 further includes a riser 110. As no drill string is required according to the present system, the riser 110 can be flexible pipe which provides for an increased watch circle for any associated surface vessel. Inclusion of a riser 110 provides for managed pressure drilling, underbalanced drilling, and management of drilling mud and cuttings.

Figure 3:
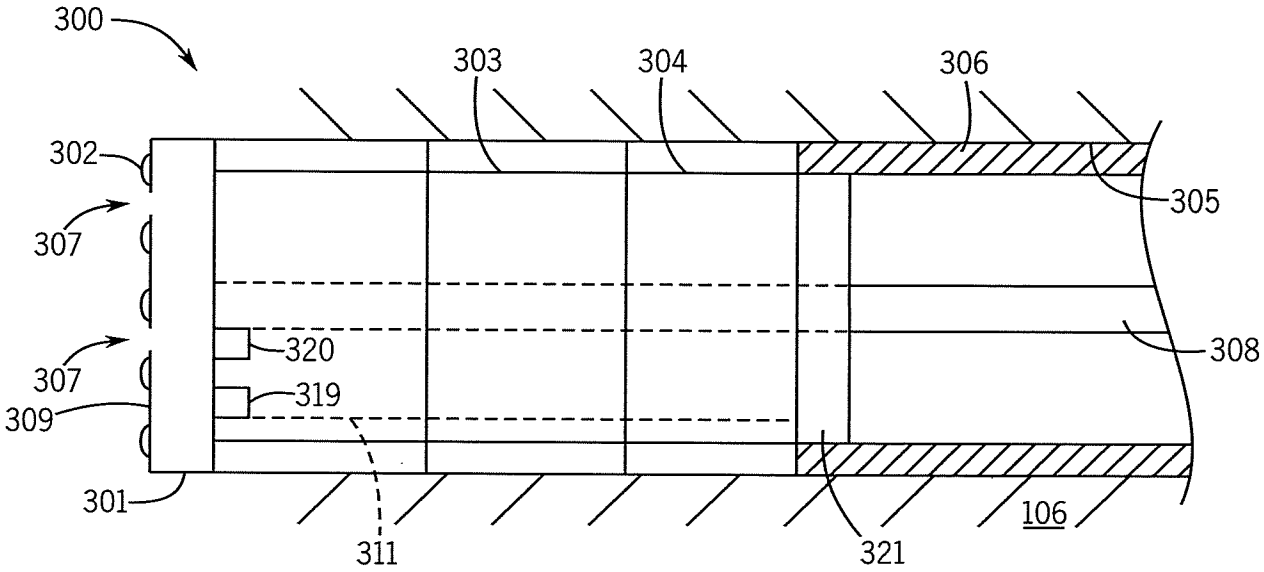
FIG. 3 is a cross-sectional view of a well boring apparatus for use in the drilling systems illustrated in FIGS. 1 and/or 2.

Referring now to FIG. 3, a cross-sectional view of a well boring apparatus 300 is shown. The well boring apparatus 300 can be used in the drilling systems 120 shown in FIGS. 1 and 2. The well boring apparatus 300 can be launched from the seabed installation 150 or from a surface location. The well boring apparatus 300 includes a rotating cutting or grinding wheel or bit 301. The rotating cutting wheel 301 has one or more teeth 302 disposed on it. The teeth 302 are contacted with a portion of a formation 106 to be drilled through. The cutting wheel 301 can also have openings 307 disposed on its face 309 which allow for cuttings to pass through the cutting wheel 301 and for the delivery of drilling mud or other fluids to the point of contact between the well boring apparatus 300 and the formation 106. After passing through the cutting wheel 301, the cuttings can be propelled to a mud line or surface location for further processing. For instance, the cuttings can be processed by equipment located at the seabed installation 150 such that a riser connecting the wellbore 305 to the surface is not required.

Alternative embodiments for propelling the cuttings up the wellbore 305 include passing the cuttings along the outside body of the well boring apparatus 300, such as by creating longitudinal flutes in the outer surface 311 of the well boring apparatus 300 to allow cuttings to flow past the well boring apparatus 300. In addition, a pump 319 can be incorporated onto the well boring apparatus 300 to force seawater through the cutting wheel 301. The seawater can wash the cuttings around or through the well boring apparatus 300 as required. In addition, a trailing apparatus 321 can be towed behind the well boring apparatus 300 to collect the cuttings and propel them up the wellbore 305. In another embodiment, multiple lines of coiled tubing 308 can be used with one tube for drilling fluid and one for clearing cuttings. The multiple coiled tubing lines 308 can be run in parallel or pipe-in-pipe.

The cutting wheel 301 is expandable (e.g., radially) and, accordingly, is of variable diameter. That is, the cutting wheel 301 can have an initial diameter when drilling operations commence. The diameter of the cutting wheel 301 can be decreased or increased on the fly during drilling operations.

The well boring apparatus 300 is at least in part self-propelled. That is, the well boring apparatus 300 includes a thrust system 303 for propelling the apparatus 300 through a wellbore 305. As discussed in FIGS. 1 and 2, the well boring apparatus 300 may be coupled to a coiled tubing spool (e.g., coiled tubing spool 108) which can provide additional thrust for moving the well boring apparatus 300 through the wellbore 305. However, this is not required. The thrust system 303 can include any components which aid to propel the well boring apparatus 300 through the wellbore 305, including gripping arms/shoes which contact the side of the formation and pull/push the well boring apparatus 300 through the wellbore 305. In addition to propelling the well boring apparatus 300 through the wellbore 305, the gripping arms/shoes can hold the well boring apparatus 300 in place against potentially high pressure flow, as well as to react against the drilling forces (e.g., torsional and longitudinal forces). The well boring apparatus 300 may further include a "shuffle counter" for counting the number of steps the gripping arms/shoes make when using a push/pull or similar driving mechanism, thereby allowing for determination of the location of the well boring apparatus 300.

The well boring apparatus 300 may further include an inertial navigation system 320 including a computer system (e.g., having an electronic controller, processor, and memory), motion sensors (e.g., accelerometers), and rotation sensors (e.g., gyroscopes) to continuously calculate via dead reckoning the position, orientation, and velocity/acceleration of the well boring apparatus 300.

The well boring apparatus 300 may further include one or more secondary modules 304. The secondary modules 304 can include additional equipment for lining/casing the wellbore 305. For instance, in the illustrated embodiment, precast lining/casing sections 306 are stored in the secondary modules 304 and are ready for deployment into the wellbore 305. The lining/casing sections 306 are attached to the formation by any appropriate means, such as by robotic manipulation. In the illustrated embodiment, the secondary modules 304 have coupled lining/casing 306 to the walls of the borehole, thereby sealing the wellbore 305 and adding structural stability to the wellbore 305. The secondary modules 304 are detachable such that once deep enough in the wellbore 305, where liner/casing is not required, the secondary module 304 can be retrieved and the well boring apparatus 300 can continue drilling operations.

As discussed above, the well boring apparatus 300 can line the bore as it progresses with drilling by using a robotic arm to attach precast lining segments 306 to the formation 106. The segments 306 can be fixed to the formation 106 by cement which is pumped downhole via the coiled tubing spool or another umbilical. The well boring apparatus 300 can be contacted with the formation 106, for instance by expanding one or more gripping arms/shoes, to anchor the well boring apparatus 300 in place and provide a means for squeezing cement into the appropriate form against the wellbore.

Alternatively, chemicals supplied by tube or umbilical, or stored at the seabed installation 150, can be delivered from the well boring apparatus 300 to the formation 106 as the well boring apparatus 300 passes through the formation 106, providing for a reaction that produces a material suitable for use as a liner. The hot temperatures in a formation can aid in curing the lining/casing. The chemicals can be maintained on a skid (e.g. the containers 117) at the subsea installation 150.

In another embodiment, a material such as spray foam can be used to fill an annular area defined by the drilled hole, the previously created lining section 306 and shuttering at the front of the lining segment 306.

In yet another embodiment, the coiled tubing can be used as the borehole liner. That is, the coiled tubing is deployed with the well boring apparatus 300. When the well boring apparatus 300 is retrieved from the wellbore 305, the coil tubing is simply left in place.

Any method of lining/casing the borehole discussed above can be accomplished by modules located on the well boring apparatus 300 or by another apparatus trailing the well boring apparatus 300. Further, any method of lining/casing the borehole discussed above can be used during initial drilling of a wellbore 305, or for maintenance/repair of a wellbore 305 if and when the need arises.

Figure 4:
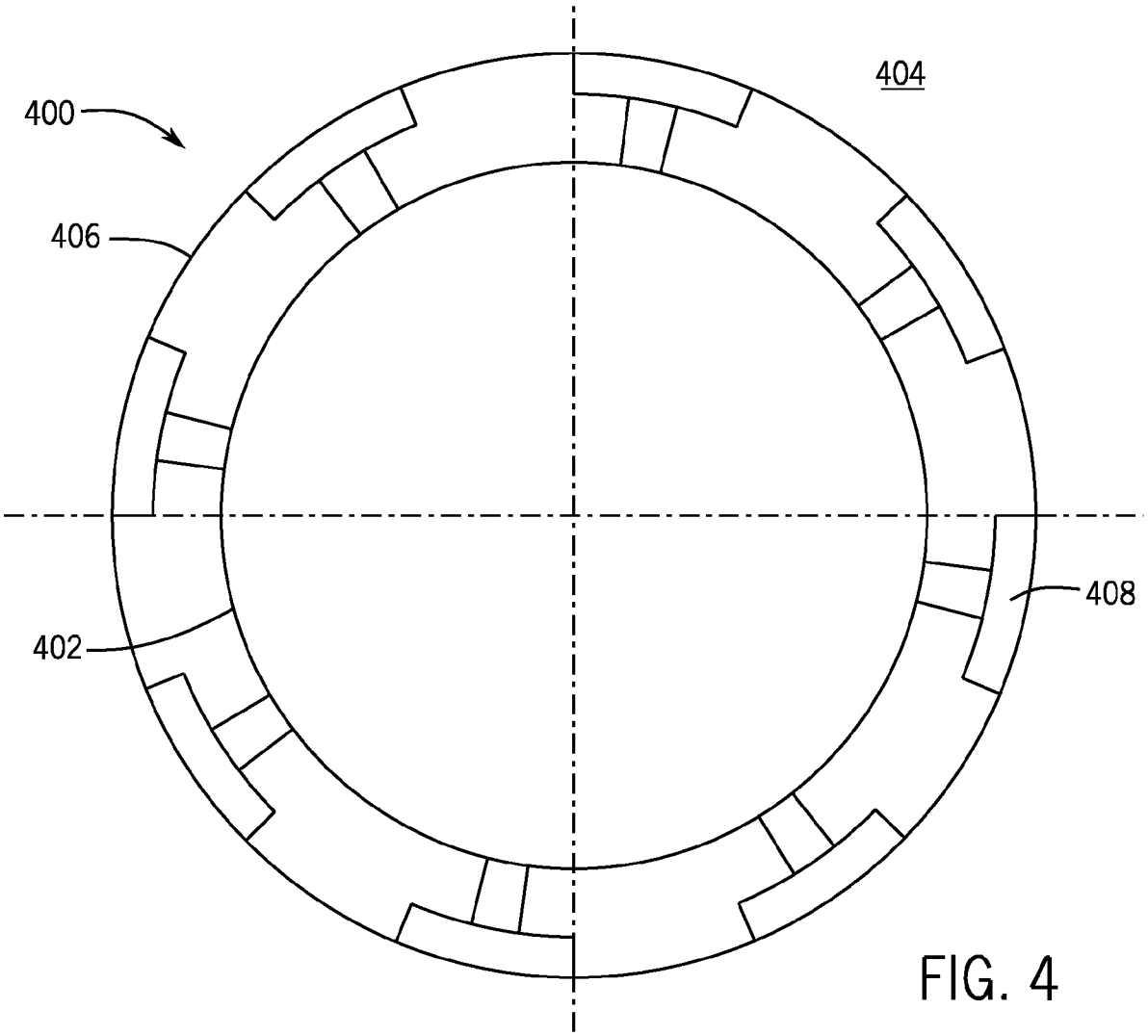
FIG. 4 is a top view of the drilling apparatus illustrated in FIG. 3.

Turning now to FIG. 4, a top view of a well boring apparatus 400 is shown, by way of example. The well boring apparatus 400 includes an outer diameter 402. The well boring apparatus 400 is penetrating a formation 404 and drilling a wellbore 406. The well boring apparatus 400 further includes gripping pads 408 configured to provide thrust and to prevent rotation of the well boring apparatus 400. The gripping pads 408 are configured to be in contact with the wellbore 406 when in an extended position, and to be flush with the well boring apparatus outer diameter 402 when in a retracted position.

Figure 5:
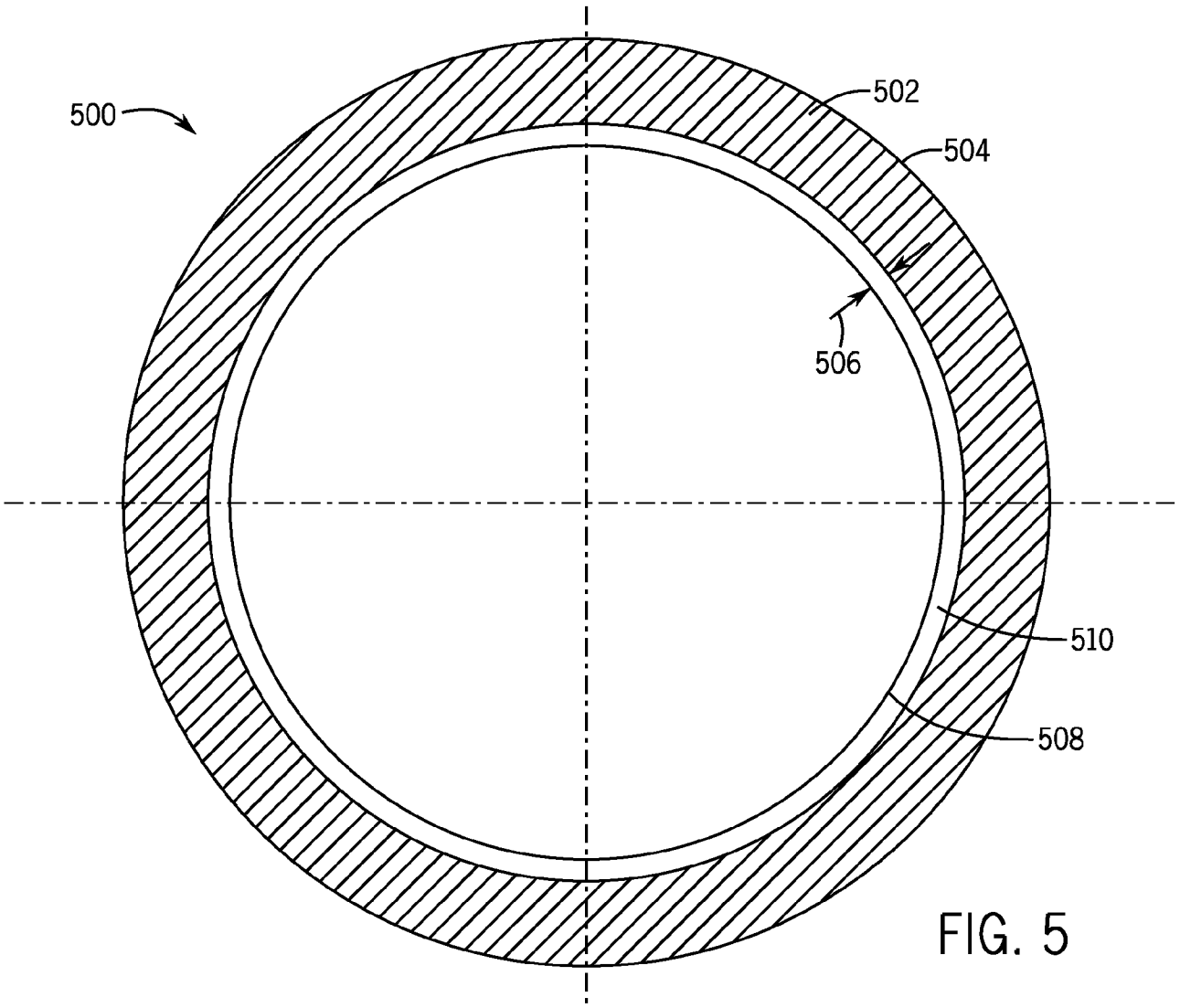
FIG. 5 is another top view of the drilling apparatus illustrated in FIGS. 3 and 4.

Turning now to FIG. 5, another top view of a well boring apparatus 500 is shown, by way of example. The hatched portion of FIG. 5 represents a void 502 (e.g., an annular space) to be filled with casing or lining material to form a structure inside the wellbore 504. The arrows illustrated in FIG. 5 represent a distance 506 by which the outer surface 508 of well boring apparatus 500/casing or lining segment must increase in order to form an annular space 510 with the wellbore 504. This distance will ensure that the well boring apparatus 500 can be recovered from the well, i.e., to travel backwards through the casing/lining it has created. The outer diameter 508 of the well boring apparatus 500 can be adjusted using a hydraulic system that drives the components radially outward or inward as desired, or through a mechanical system that moves various segments to adjust the outer diameter 508.

The disclosed embodiments provide for a more energy efficient drilling system compared to existing systems. In modern extended reach drilling, only 5% to 10% of surface energy reaches the drill bit. Accordingly, a large portion of the power of conventional rig top drives is wasted by having to overcome frictional losses along the drill string. A drilling system without a drill string can use less power to drill the same well due to the absence of frictional losses.

The drilling system could be more time efficient than existing drilling systems. Since a drill string is not required, time is not required to make up and dismantle the drill string.

In addition, in some embodiments no casing needs to be run into the well because the well boring apparatus generates casing as it progresses through the wellbore.

Further, the proposed embodiments can move away from traditional drilling systems wherein a very large initial borehole is drilled and incrementally changed to an ever smaller borehole as depth increases. The present disclosure provides for essentially constant borehole diameter throughout.

While the aspects of the present disclosure may be susceptible to various modifications and alternative forms, specific embodiments have been shown by way of example in the drawings and have been described in detail herein. It should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A well boring apparatus for elongating a wellbore through a subterranean formation comprising:

an elongating member;

a thrust system configured to propel the well boring apparatus through the wellbore;

a secondary apparatus coupled to the thrust system, wherein the secondary apparatus is configured to carry a plurality of precast casing sections and to progressively couple the plurality of precast casing sections to each other within the wellbore, wherein the secondary apparatus is positioned axially behind the thrust system in a drilling direction; and a tertiary apparatus coupled to the thrust system, wherein the tertiary apparatus is configured to process drill cuttings formed by the elongating member.

2. The well boring apparatus of claim 1, wherein the elongating member comprises a cutting or grinding wheel or bit.

3. The well boring apparatus of claim 1, wherein the thrust system comprises gripping arms configured to contact the subterranean formation.

4. The well boring apparatus of claim 3, wherein the gripping arms are configured to move between an extended position in which the gripping arms engage the wellbore and a retracted position in which the gripping arms are flush with the well boring apparatus.

5. The well boring apparatus of claim 3, wherein the gripping arms are positioned at discrete locations about the circumference of the well boring apparatus.

6. The well boring apparatus of claim 1, wherein the elongating member comprises a surface comprising one or more openings configured to receive cuttings from the subterranean formation as the wellbore is elongated.

7. A subsea drilling system comprising:

a well boring apparatus for elongating a wellbore in a subsea formation comprising:

an elongating member;

a thrust system configured to propel the well boring apparatus through the wellbore;

a pump coupled to the well boring apparatus, wherein the pump is configured to enter the wellbore with the well boring apparatus and to pump water to remove cuttings as the well boring apparatus drills the wellbore; and a trailing apparatus coupled to the well boring apparatus and coupled to a tubing, wherein the trailing apparatus is configured to collect the cuttings and propel them through the tubing;

wherein the elongating member comprises a cutting wheel and the thrust system comprises gripping arms configured to propel the well boring apparatus through the wellbore; and wherein the subsea drilling system further comprises a counter configured to count steps of the gripping arms to determine a location of the well boring apparatus.

8. The subsea drilling system of claim 7, further comprising a coiled tubing spool disposed at a subsea location, wherein a coiled tubing extends from the coiled tubing spool and is coupled to the well boring apparatus.

9. The subsea drilling system of claim 7, further comprising a secondary apparatus selected from one or more of a power unit, a control unit, a communications unit, a sensor unit.

10. The subsea drilling system of claim 7, further comprising a riser configured to provide fluid communication between the wellbore and a vessel located at a surface location.

11. The subsea drilling system of claim 7, comprising a skid positioned at a subsea location and configured to support one or more modular systems that facilitate operation of the well boring apparatus.

12. The subsea drilling system of claim 11, comprising an autonomously operated vehicle or a remotely operated vehicle configured to install the modular systems at the skid or to retrieve the modular systems from the skid.

13. The subsea drilling system of claim 7, further comprising a secondary apparatus configured to position precast casing within the wellbore as the wellbore is elongated.

14. A method of casing a wellbore comprising:

elongating a wellbore with a drilling system comprising a well boring apparatus, a secondary module;

carrying a plurality of precast casing sections into the wellbore with the well boring apparatus;

progressively coupling the plurality of precast casing sections to each other within the wellbore with the secondary module while elongating the wellbore; and counting steps of gripping arms to determine a location of the well boring apparatus.

15. The method of claim 14, wherein casing the wellbore comprises reacting a material with the wellbore to form the casing while elongating the wellbore.

16. The method of claim 14, comprising propelling the well boring apparatus through the wellbore via actuation of the gripping arms.

17. The method of claim 16, comprising collecting cuttings with a trailing apparatus and propelling the cuttings through the wellbore.

* * * * *